US010799804B2

(12) United States Patent
Walser et al.

(10) Patent No.: US 10,799,804 B2
(45) Date of Patent: Oct. 13, 2020

(54) ROLLER COASTER VEHICLE

(71) Applicants: Willy Walser, Murg (CH); Roman Rothe, Schübelbach (CH)

(72) Inventors: Willy Walser, Murg (CH); Roman Rothe, Schübelbach (CH)

( * ) Notice: Subject to any disclaimer, the term of this patent is extended or adjusted under 35 U.S.C. 154(b) by 0 days.

(21) Appl. No.: 16/082,124

(22) PCT Filed: Mar. 6, 2017

(86) PCT No.: PCT/EP2017/055227
§ 371 (c)(1),
(2) Date: Sep. 4, 2018

(87) PCT Pub. No.: WO2017/153358
PCT Pub. Date: Sep. 14, 2017

(65) Prior Publication Data

US 2019/0091586 A1 Mar. 28, 2019

(30) Foreign Application Priority Data

Mar. 11, 2016 (EP) ..... 16159842

(51) Int. Cl.
*A63G 21/08* (2006.01)
*A63G 21/20* (2006.01)
*A63G 7/00* (2006.01)

(52) U.S. Cl.
CPC ..... *A63G 21/20* (2013.01); *A63G 7/00* (2013.01); *A63G 21/08* (2013.01)

(58) Field of Classification Search
CPC ..... A63G 7/00; A63G 21/08; A63G 21/20
USPC ..... 104/74–76
See application file for complete search history.

(56) References Cited

U.S. PATENT DOCUMENTS 4,170,943 A * 10/1979 Achrekar ..... A63G 21/08 104/56
4,724,771 A * 2/1988 Yamada ..... A63G 21/08 104/127
4,842,267 A * 6/1989 Kastner ..... A63G 1/24 472/30
4,898,377 A * 2/1990 Roche ..... A63G 31/16 472/130
5,782,699 A * 7/1998 Harrap ..... A63G 9/00 472/118
5,820,469 A * 10/1998 Nobbs, Jr. ..... A63G 1/28 472/33

(Continued)

FOREIGN PATENT DOCUMENTS

CN 202620681 U 12/2012
DE 102007047289 A1 12/2008

(Continued)

*Primary Examiner* — Zachary L Kuhfuss
(74) *Attorney, Agent, or Firm* — Thomas M Freiburger

(57) ABSTRACT

The invention relates to a roller coaster vehicle guided along a rail structure extending in a two- or three-dimensional plane and having at least one passenger seat (3), which is fastened to a chassis (2) guided on the rail structure, wherein the passenger seat (3) is fastened to the chassis (2) by way of an axis of rotation (16, 17) extending in a longitudinal direction of the vehicle, and the rotation of the passenger seat (3) can be influenced manually during the ride of the roller coaster vehicle. According to the invention, a rotation about the axis of rotation (16, 17) can be influenced by the force of an airflow along adjustable air guiding wings (18, 19) on the vehicle.

6 Claims, 6 Drawing Sheets

(56) References Cited

U.S. PATENT DOCUMENTS

| | | | | |
|---|---|---|---|---|
| 6,523,479 | B1 * | 2/2003 | Schilke | A63G 7/00 104/57 |
| 7,594,473 | B2 * | 9/2009 | Kitchen | A63G 7/00 104/53 |
| 7,610,859 | B1 * | 11/2009 | Dietrich | A63G 21/08 104/53 |
| 8,066,576 | B2 * | 11/2011 | Threlkel | A63G 7/00 104/53 |
| 8,141,495 | B2 * | 3/2012 | Baker | A63G 7/00 104/60 |
| 8,176,853 | B2 * | 5/2012 | Nemeth | A63G 7/00 104/139 |
| 8,398,497 | B2 * | 3/2013 | Crawford | A63G 31/16 472/43 |
| 8,573,131 | B2 * | 11/2013 | Nemeth | A63G 7/00 104/75 |
| 8,931,417 | B2 * | 1/2015 | Shasha | A63G 1/30 104/91 |
| 9,120,023 | B1 * | 9/2015 | Burroughs | A63G 21/20 |
| 9,144,745 | B2 * | 9/2015 | Snyder | A63G 7/00 |
| 9,643,094 | B2 * | 5/2017 | White | A63G 21/06 |
| 9,675,893 | B2 * | 6/2017 | Snyder | A63G 7/00 |
| 9,802,131 | B2 * | 10/2017 | Zamperla | A63G 1/30 |
| 10,005,477 | B2 * | 6/2018 | Louwsma | A63G 21/20 |
| 10,155,171 | B2 * | 12/2018 | Crawford | A63G 27/02 |
| 2014/0360398 | A1 | 12/2014 | Chick | |
| 2017/0106878 | A1 * | 4/2017 | Louwsma | A63G 21/22 |
| 2017/0232352 | A1 * | 8/2017 | White | A63G 21/06 104/75 |
| 2018/0304160 | A1 * | 10/2018 | White | A63G 31/08 |
| 2019/0091586 | A1 * | 3/2019 | Walser | A63G 7/00 |

FOREIGN PATENT DOCUMENTS

| | | | |
|---|---|---|---|
| DE | 102007062937 | A1 | 7/2009 |
| DE | 102008003426 | A1 | 7/2009 |
| DE | 202010000403 | U1 | 9/2011 |
| KR | 1020090084620 | A | 8/2009 |

* cited by examiner

ROLLER COASTER VEHICLE

BACKGROUND OF THE INVENTION

This application claims priority from international application number PCT/EP2017/055227, filed Mar. 6, 2017 and European application No. EP16159842.0, filed Mar. 11, 2016.

The invention relates to a roller coaster vehicle guided along a rail structure extending in a two- or three-dimensional plane and having at least one passenger seat, which can swivel interactively about at least one axis of rotation.

Roller coaster vehicles are traditionally open carriages which are joined to form an articulated train and are raised or propelled by a motor along a three-dimensional rail structure from a starting point to a starting height and then travel back to the starting point along the structure of the rollercoaster substantially solely due to gravity and centrifugal force. At critical locations and also for increased safety, such a rollercoaster can also include intermediate drives or block brakes contained, which can speed up the roller coaster vehicle again or stop it safely.

Roller coaster vehicles are also subject to continuous change and modernization, in which the vehicle structures are dismantled and individual seats are fastened to a train chassis, wherein the individual seats are arranged at the side of the train vehicle chassis, and so passengers on the seats have a free view downwards. However, this type of arrangement of passenger seats necessitates special safety measures, such as complex retaining arms.

A roller coaster vehicle is known from DE 20 2010 000403 U1, wherein seats arranged at the side of the vehicle chassis are used which each have electrical drives in order to be able to rotate the seat about a vertical axis during the ride. In addition, the shell-like seats can be pivoted about a horizontal axis. The actuation for pivoting or rotation of the passenger seat takes place by means of an actuating element on the vehicle seat, which is configured for example as a joystick.

Although this vehicle design allows pivoting about a horizontal axis or rotation about a vertical axis, the large number of driving elements necessary on the roller coaster vehicle, wherein each individual seat has to be equipped with corresponding driving elements, results in a considerable weight, which necessitates a high energy consumption, requires a correspondingly configured rail system and requires complex control with high maintenance costs.

A roller coaster vehicle which allows pivoting of a seat about a transverse axis is also known from DE 10 2007 047289 A1.

Therefore, in a roller coaster vehicle which is guided along a rail structure extending in a two- or three-dimensional plane and is provided with rotatable or pivotable passenger seats, the object of the invention is to create the possibility of carrying out movements in a simple manner in different planes, including rollover movements, along longitudinal or transverse axis.

According to the invention the rotation about an axis of rotation extending in the direction of travel is influenced by the force of an airflow along adjustable air guiding wings on the vehicle.

According to the invention it is sufficient if correspondingly configured air guiding wings are arranged on the vehicle, the adjustment of said wings causing a change in the airflow around the vehicle, so that the vehicle or the passenger seat rotates about a longitudinal axis extending in the direction of travel of the vehicle. During movement of the vehicle in a horizontal plane the axis of rotation or the axis of rotation of the vehicle extends in a horizontal direction. The passenger on the passenger seat can preferably control the rotation manually. In this way, with a correspondingly fast ride and corresponding adjustment of the air guiding wings it is possible during the ride also to carry out 360° rotations about the longitudinal axis of the vehicle.

The rotation can preferably be set or limited as a function of the traveled line section. In line sections having high acceleration or centrifugal forces it may be expedient for safety reasons to limit the rotation to a specific pivoting and to prevent rollovers. This safety provision can also be servo assisted, so that the passenger who cannot immediately discern the potential risk is prevented from performing a rotation in dangerous situations or from being tempted into extreme situation which endanger him. The servo assistance can also be used so that in the event of a slow ride, in which the airflow is not sufficient to pivot the vehicle, pivoting or rotation can nevertheless be carried out.

If a plurality of passenger seats are used, these are preferably fastened to the chassis and moved in a transverse direction in the vehicle. Thus, they hang freely alongside the rail structure. In this case the pivoting or rotation of the vehicle seats takes place in a plane which extends at an angle of 90° to the longitudinal axis of the vehicle or the rail structure.

In order to facilitate a rotation of the passenger seat only during the ride, the passenger seat is moved into a starting position as soon as the vehicle has reached the end point of a ride or a passenger has embarked or disembarked. This can take place by actuation of an operating member, which for example suitably sets the wing position of the air guiding wing or also, as the aerodynamic force of the air guiding wing is overcome by motor force, wherein the aerodynamic force when a slow speed or standstill is reached is in any case negligible. However, a starting position of the vehicle seat in upright position is nevertheless necessary. The servo drive must also be able to rotate the passenger seats into the safe starting position before introduction of a block brake.

The vehicle preferably has sensors in order to ascertain the respective location at which the vehicle is currently located. This is expedient not only for ascertaining the end point of the route, but also for specific intermediate points of the route at which an intervention in the wing position of the air guiding wing is necessary or expedient or a servo assisted movement is required.

The passenger seat is preferably fastened with its rear end on an axis of rotation which is located somewhat above the center of gravity of a large and heavy passenger in order to avoid a passenger seat tipping over into a neutral position. However, when passengers embark or disembark it is necessary to prevent any rotation of the passenger seat.

The air guiding wing or the actuating lever for actuation of the air guiding wings are preferably subject to spring force, wherein the air guiding wings are biased into the rest position. A deflection of the air guiding wing therefore necessitates a positive actuating of a joystick.

In a further embodiment of the invention it can also be provided that in addition to rotation or pivoting about a horizontal longitudinal axis of the vehicle an additional rotation can take place about a vertical axis in relation to the vehicle in a horizontal plane. Such a rotation can also take place mechanically, as the passenger seat operates an additional air guiding wing attached to the vehicle in the manner of a rudder of an airplane.

Due to the invention a roller coaster vehicle is created in a simple manner which allows rotations or pivoting of passenger seats solely manually, wherein the movement can be controlled interactively by the passenger himself.

The invention is explained in greater detail below with reference to an embodiment. In the drawings:

FIG. 1 shows a side view of a roller coaster vehicle in the case of a rectilinear ride, FIG. 2 shows a plan view of a roller coaster vehicle of FIG. 1, FIG. 3 shows a side view of a roller coaster vehicles on a concavely curved section of the track, FIG. 4 shows a side view of a roller coaster vehicles on a convexly curved section of the track, FIG. 5 shows a plan view of a horizontally curved section of the track, FIG. 6 shows a side view of a vehicle seat, and FIG. 7 shows a front view of two vehicle seats arranged parallel.

According to FIG. 1 a plurality of seats 3 are in each case fastened to a chassis 2. The chassis 2 are connected to one another in an articulated manner by means of longitudinal supports 4 and coupling connections 5 and run along a rail 1, wherein the seats 3 are arranged in two parallel rows each comprising 6 seats, which are fastened to the respective chassis 2 by means of seat holders 6.

FIG. 2 shows a view corresponding to FIG. 1 in plan view, i.e. rotated about 90° in a vertical plane. The view shows that in each case six seats 3 are arranged on both sides of the rail 1, so that the entire roller coaster vehicle overall contains twelve individual seats. These are located alongside the track 1 in a suspended arrangement, as is illustrated in FIG. 1.

FIG. 3 shows the configuration of the roller coaster vehicle on a convexly curved section of the track with a rail 1, wherein it is clear that the individual seats and chassis are connected to one another in an articulated manner by means of the longitudinal supports 4 and the couplings 5.

Figure 1:
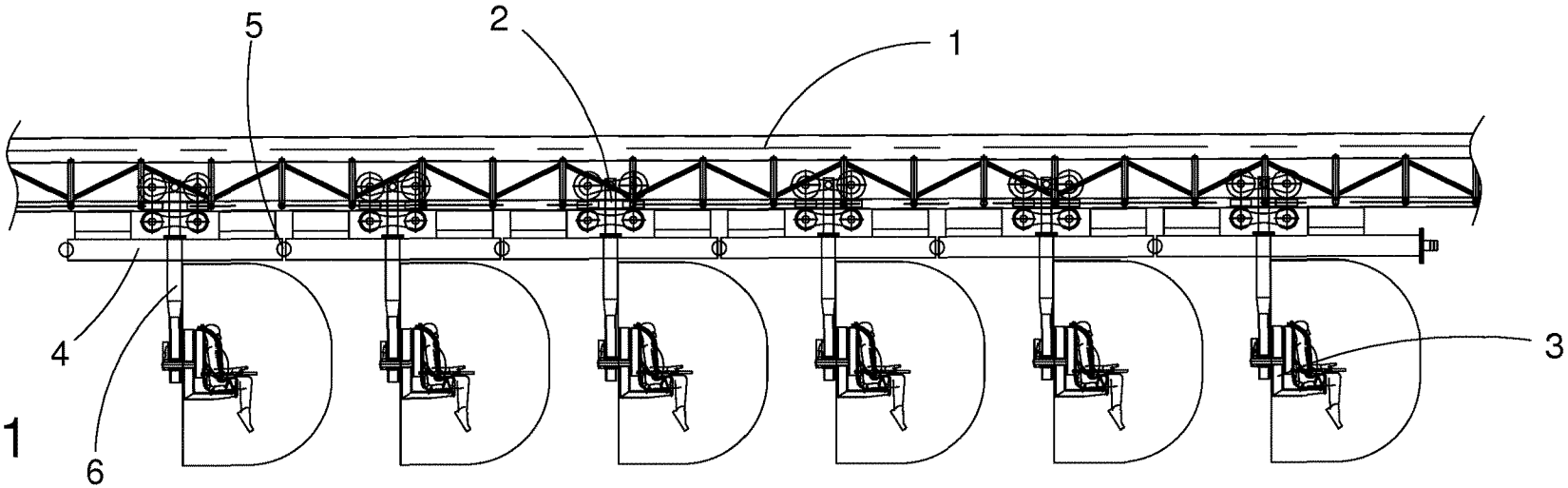
Figure 2:
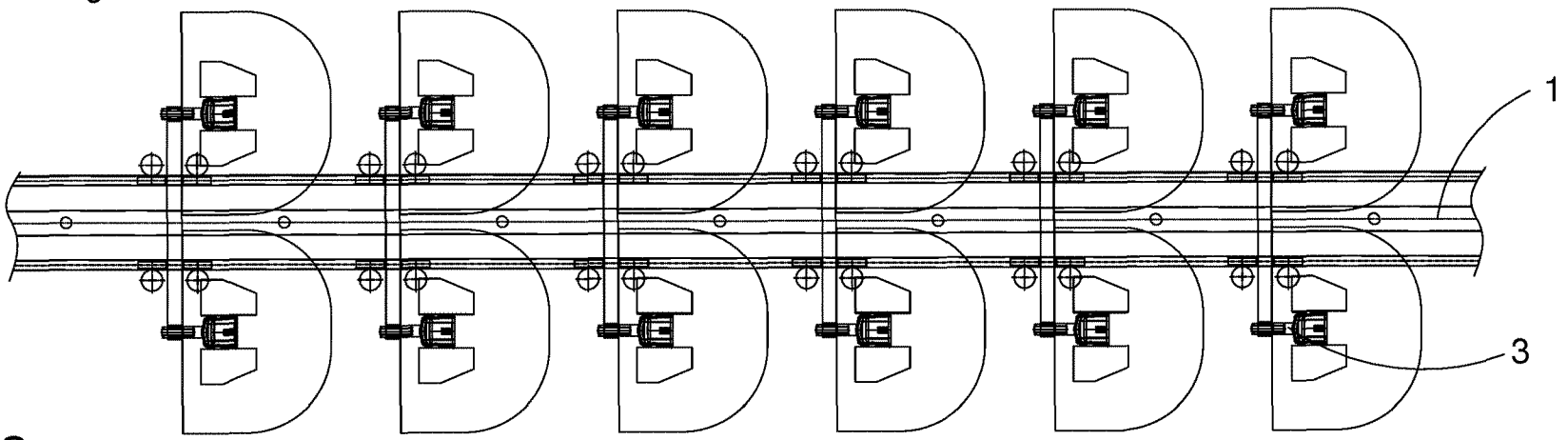
Figure 3:
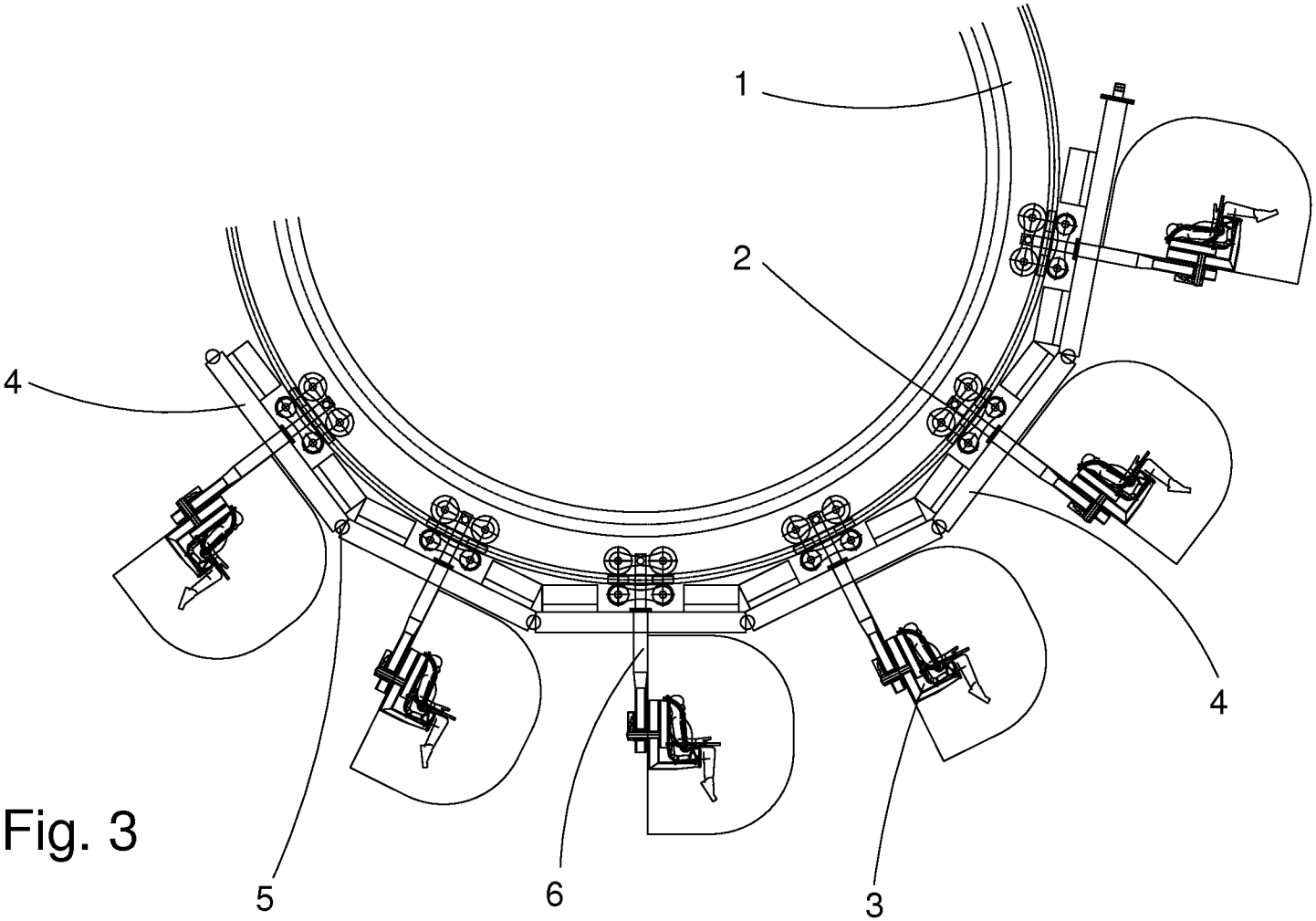
Figure 4:
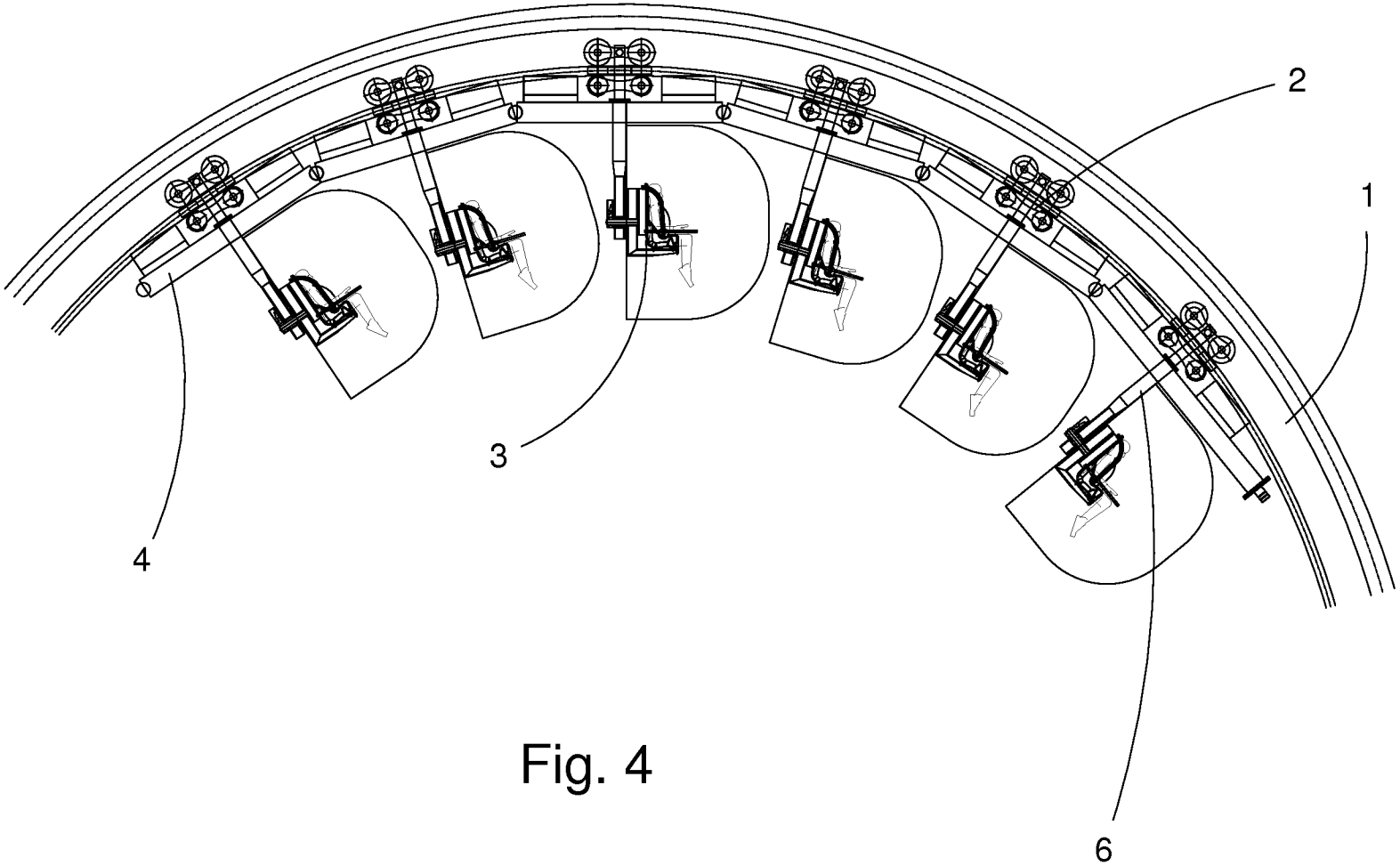
FIG. 4 shows a side view of a roller coaster vehicle on a concavely curved section of the track. The roller coaster vehicle can therefore be operated both in concave and also convex narrow curves.
Figure 5:
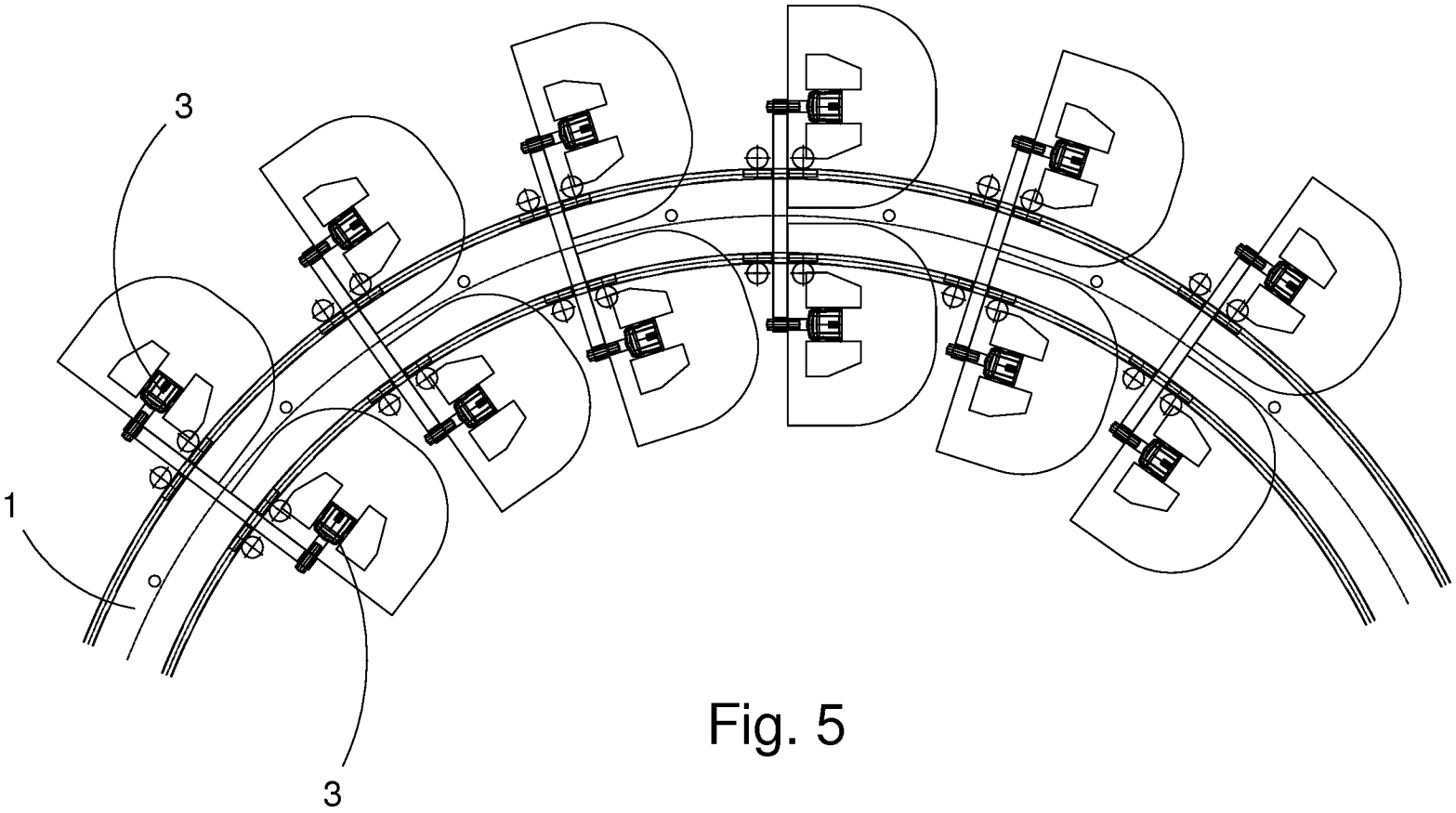
FIG. 5 shows a view with a horizontally curved section of the track, in which it is clear that narrow lateral bends can also be managed, provided that the "working space" of a seat 3 does not impede the corresponding adjacent "working space" of an adjacent seat.
Figure 6:
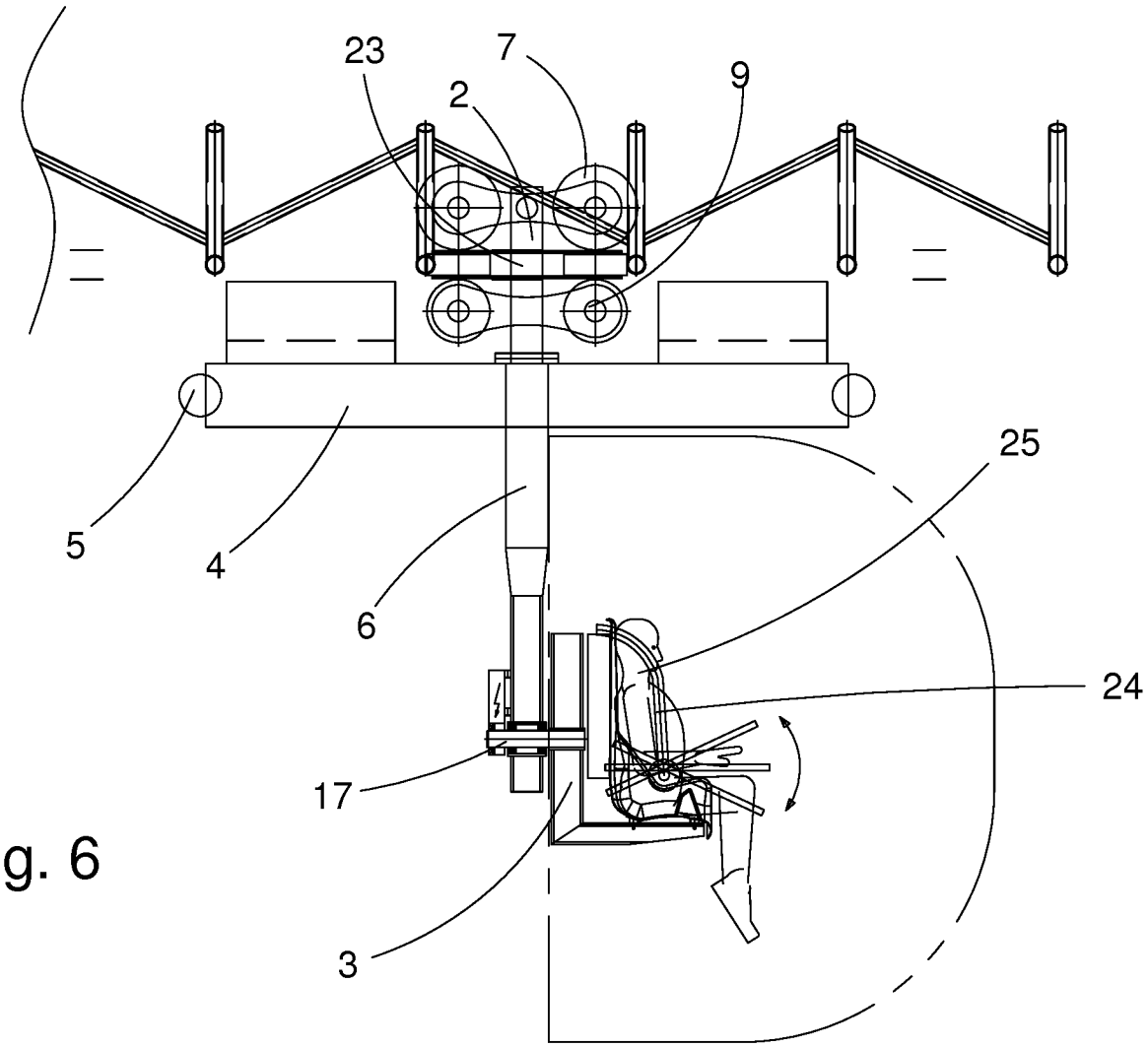

FIG. 6 shows a side view of an individual seat 3, which is fastened by means of the seat holder 6 to a chassis 2 which runs on the rail 1 of the rollercoaster, which is only illustrated schematically. The chassis 2 includes wheel sets which are known per se and engage around the running rails from above and below as well as laterally. The upper carrier wheel 7 substantially bears the weight of the chassis 2 and the seat 3, whilst the supporting wheel 9 serves from below for support against lifting off of the seat arrangement from the track. The supporting wheel 23 is responsible for the lateral security.

The seat 3 is fastened to the seat holder 6 by means of a substantially free running axis of rotation 17 extending in the longitudinal direction of the vehicle. The seat has the usual personal safety equipment 24 for a person 25. Thus, the seat 3 is pivotable about the axis 17 in a plane transversely with respect to the direction of travel.

Figure 7:
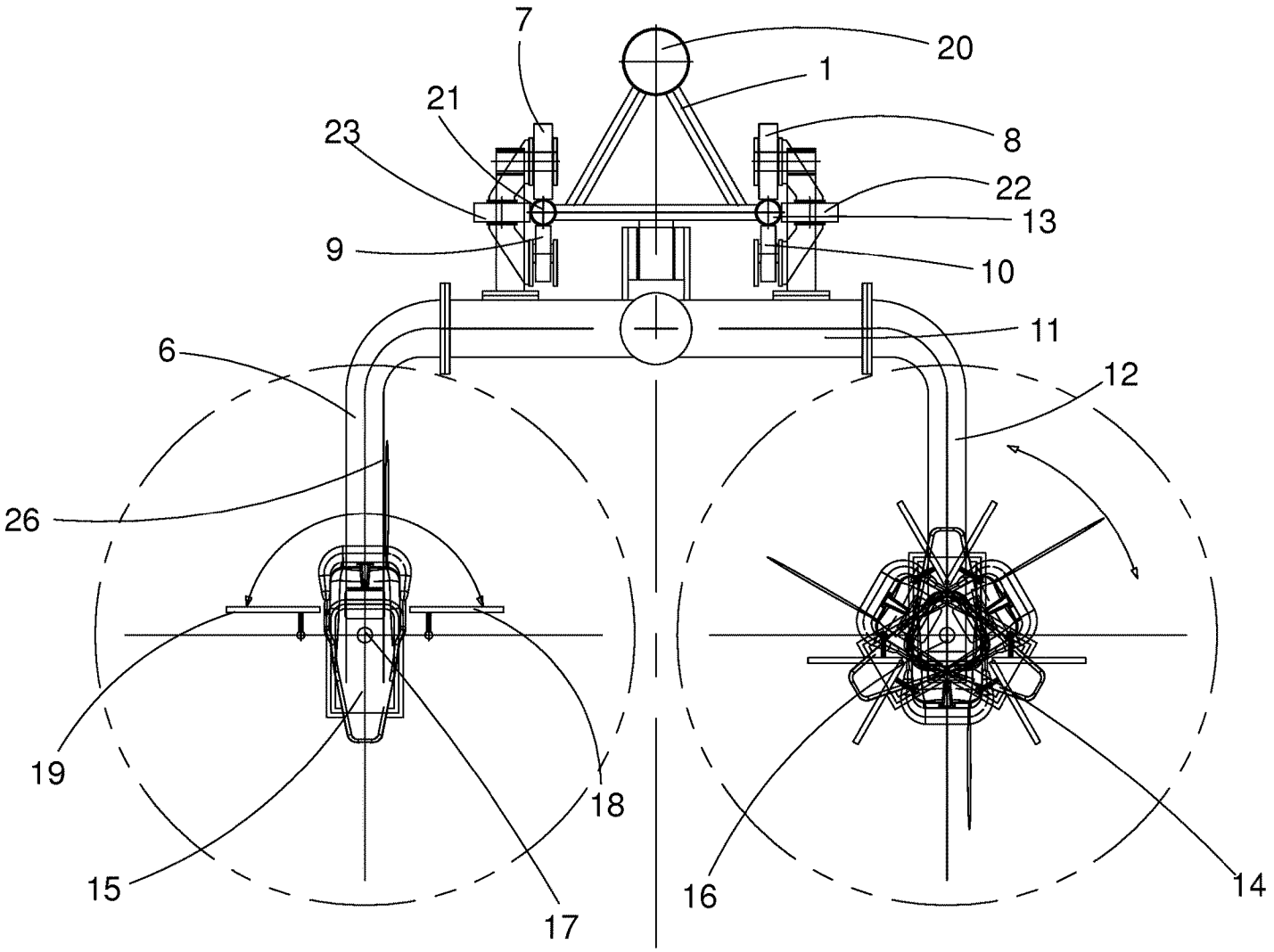

FIG. 7 shows the seat arrangement in a front view. The route of the rollercoaster structure is formed substantially by a triangular frame structure with an upper main rail 20 and two lower running rails 13, 21. The seat unit is mounted by means of a wheel set mounting on the running rails 13 and 21. The wheel set consists of pairs of upper carrier wheels 7 and 8, pairs of lower supporting wheels 9 and 10 as well as lateral supporting wheels 22 and 23. Thus all the degrees of freedom of the chassis 2 are fixed on the rail structure.

The transverse support 11, the lateral ends of which merge into the seat holders 6 and 12, which are directed downwards, is fastened to the lower end of the chassis 2. The actual seats are fastened to the lower ends of the seat holders 6 and 12 by means of the axes of rotation 16 and 17 oriented in the longitudinal direction of the vehicle. The seats can be pivoted about the axes of rotation 16 and 17 or they can also be turned around, by more than 360°.

Since the center of rotation of the axes of rotation 16 and 17 is located more or less above or close to the center of gravity, which is constituted by the seat and the person located thereon, the seat in the rest state hangs downwards or in the centrifugal force direction, wherein if its movement is not braked it can also pivot back and forth. In the event of lateral forces, such as for example centrifugal forces, which occur in horizontal or spiral curves of the rollercoaster, the seats are thus strongly deflected laterally.

The deflection can be controlled in a special way by a manual interaction. For this purpose, each passenger seat has a manual control means, for example in the form of a joystick, by means of which two air guiding wings 18 and 19, attached laterally to the seat, can be tilted upwards or downwards. The air guiding wings are fastened at their front or rear transverse end to a transverse axis of the seat and are moved synchronously in opposite directions by means of a lever linkage or cable hoists. If the joystick is deflected in a lateral direction, one air guiding wing moves upwards and the other air guiding wing moves downwards, so that air flowing along the air guiding wing exerts a force on the air guiding wing which is transmitted to the seat. A pivoting of the seat is caused by its free mounting by means of the axes of rotation 16 or 17. The joystick, the lever linkage or the air guiding wings are biased by means of a spring arrangement into the rest position, so that when the joystick is released this effects a return of the air guiding wing into the starting position.

If the pivoting or rotation of the seat is not limited due to stops, rollovers can be performed during the ride. As a result, however, unauthorized situations could occur in specific ride sections, so that measures are provided in order to provide a limitation of the rotation or pivoting to for example ±20° or ±45° in these route sections. For this purpose, sensors are provided on the seats or the roller coaster vehicle, and on the approach to a corresponding route section these sensors ensure, by interaction with transmitters/receivers or mechanical controls provided on the relevant line sections, that the pivoting movement of the individual seats is limited or the seats are transferred to a specific safe position. After leaving the critical route section the movements can also be released again. Accordingly, a resetting of the air guiding wings takes place as the roller coaster vehicle approaches the end point of the route, in order to ensure a rest position of the seat for passengers to embark and disembark. Likewise, a resetting of the seat can take place during a slow ride and thus when there is insufficient pressure on the air guiding wings.

In FIG. 7, in the right-hand illustration, it is shown that the passenger seat can occupy a number of different positions which can be reached during the pivoting or rotation by means of the air guiding wings.

Although the fundamental principle of the invention consists of a manual control during pivoting or rotation of passenger seats, the rotation or pivoting can also be supported by a motor-powered drive, in particular by a servo control. This makes it possible to provide the pivoting or rotation even on those route section regions in which the roller coaster vehicle still has not achieved sufficient speed in order to cause a rotation by influencing the airflow due to adjusted air guiding wings. The motor-controlled movement can be triggered by the passenger himself or can also be carried out by a central control unit directly or under program control, so that individual seats, seats arranged in groups or also all seats can be centrally pivoted or moved into the normal position.

If the seat holders 6 and 12 are not constructed rigidly in one piece, but have an axial rotary coupling, it can also be made possible to perform a rotation of the vehicle about an axis extending vertically relative to the vehicle. Such a rotation can also be brought about by an airflow, by the use of an air guiding wing 26 which is configured in the form of a rudder on the vehicle and can likewise be connected by means of a linkage to the joystick. The direction of movement of the joystick for the aileron at a 90° angle to the direction of movement for the rudder. Also, when a rudder is used suitable measures should be implemented in order to be able to maintain safety over the entire route. A further possibility for movement can be achieved if a pendulum movement of the seat about a horizontal or vertical axis is permitted and/or carried out in a controlled manner.

With the invention different movements can be controlled by the passenger interactively and independently. The seat arrangements can be configured differently. Open gondolas or also closed gondolas can be used. If the section configuration of a rollercoaster is selected so that in specific line sections the seats are moved past but relatively close to an obstacle, such as a pool of water, it can be left to the passenger whether to touch the water for example with the feet or also to avoid the obstacle. Avoidance maneuvers can also be motor-controlled, in that the additionally provided motor-powered control for the region of the special route section predetermines a special position of the seat, for example a horizontal position.

The vehicle is driven by means of friction wheels, linear motors or chains, as is usual for rollercoasters or switchbacks or mountain and valley railways in specific line sections, or by self-propulsion of the vehicle.

The seats of the vehicle can also be equipped with VR spectacles by which the passengers can be provided with a ride through virtual spaces.

LIST OF

1 rail
2 chassis
3 seat
4 longitudinal support
5 coupling
6 seat holder
7 carrier wheel
8 carrier wheel
9 supporting wheel
10 supporting wheel
11 transverse support
12 seat holder
13 running rail
14 seat
15 seat
16 horizontal axis of rotation
17 horizontal axis of rotation
18 air guiding wing
19 air guiding wing
20 main rail
21 running rail
22 supporting wheel
23 supporting wheel
24 personal safety equipment
25 person
26 air guiding wing

The invention claimed is:

1. A roller coaster vehicle which is guided along a rail structure extending in three dimensions, the roller coaster having a series of chassis connected to one another in an articulated manner by means of longitudinal supports and coupling connections and having at least one passenger seat (3), which is fastened to a chassis (2) guided on the rail structure, wherein the passenger seat (3) is fastened to the chassis (2) by way of an axis of rotation (16, 17) essentially extending fixedly in the movement direction offset parallel to the rail structure, and the rotation of the passenger seat (3) can be influenced manually by the passenger on the passenger seat (3) during the ride of the roller coaster vehicle, wherein a rotation about the axis of rotation (16, 17) can be controlled by the force of an airflow along adjustable air guiding wings (18, 19) on the seat, characterized in that at least two rotatable passenger seats (14, 15) are mounted to the chassis (2) in cross direction of the vehicle, offset against each other such that one passenger seat is positioned on each side of the rail structure, each of the passenger seats being controllable independently of each other, and wherein the passenger seats are face toward the movement direction and their axis of rotation is essentially parallel to the movement direction of the vehicle;

the rotation can be set or limited depending on the traveled line section;

the rotation is assisted by means of a servo drive;

the vehicle is provided with sensors for determining the vehicle's location and that sensors are provided for ascertaining the end point of a ride; and the seats are rotatable about an axis of rotation (16, 17) which extends above the center of gravity of the seat when occupied by a passenger (25) and below the head of the passenger, and in that the passenger seats occupy a suspended position when in the resting state.

2. The roller coaster vehicle according to claim 1, characterized in that the passenger seats (3, 14, 15) are able to carry out one or more rollovers about said axis of rotation, and that the passenger seat or seats (3,14,15) occupy a suspended position in an initial position of the air guiding wing (18, 19).

3. The roller coaster vehicle according to claim 2, characterized in that the air guiding wings (18, 19) are biased into the basic position by spring force.

4. The roller coaster vehicle according to claim 1, characterized in that the vehicle seats (3, 14, 15) are suspended on the chassis (2) by means of an intermediate support by means of a rotation axis extending in cross direction to the movement direction, so as to swing.

5. The roller coaster vehicle according to claim 4, characterized in that the swinging of the vehicle seats on the rotation axis extending in cross direction can be adjusted by means of an air guiding wing (26) extending parallel to said rotation axis.

6. The roller coaster vehicle according to claim 1, characterized in that the passenger seats are returned to their initial position when the vehicle has reached the end point of a ride.

* * * * *